United States Patent [19]

Funke

[11] 4,360,059

[45] Nov. 23, 1982

[54] TUBE TYPE HEAT EXCHANGER

[75] Inventor: Karl-Heinz Funke, Gronau, Fed. Rep. of Germany

[73] Assignee: Funke Warmeaustauscher Apparatebau KG, Gronau, Fed. Rep. of Germany

[21] Appl. No.: 251,465

[22] Filed: Apr. 6, 1981

Related U.S. Application Data

[63] Continuation of Ser. No. 947,062, Sep. 29, 1978, abandoned.

[30] Foreign Application Priority Data

Oct. 1, 1977 [DE] Fed. Rep. of Germany ..... 2744263

[51] Int. Cl.[3] ..... F28D 7/00; F28F 9/00

[52] U.S. Cl. ..... 165/160; 165/162; 165/184

[58] Field of Search ..... 165/159-162, 165/184; 285/330; 138/38, 42

[56] References Cited

U.S. PATENT DOCUMENTS

| | | | |
|---|---|---|---|
| 171,245 | 12/1875 | Sage | 285/330 |
| 948,835 | 2/1910 | Walter | 165/160 |
| 1,173,234 | 2/1916 | Whitman | 285/330 X |
| 1,525,094 | 2/1925 | Jones | 165/161 |
| 2,060,936 | 11/1936 | Haag, Jr. | 165/184 |
| 2,287,066 | 6/1942 | Rogers | 165/184 X |
| 3,030,293 | 4/1962 | Wyatt | 165/184 X |

FOREIGN PATENT DOCUMENTS

| | | | |
|---|---|---|---|
| 21873 | of 1898 | United Kingdom | 138/38 |
| 631860 | 11/1949 | United Kingdom | 165/159 |

*Primary Examiner*—Sheldon J. Richter

*Attorney, Agent, or Firm*—Lockwood, Dewey, Alex & Cummings

[57] ABSTRACT

Elements and tube-type heat exchanger employing such elements include a hollow core and a spiral baffle formed integrally with the core and extending axially thereof. The spiral baffle includes openings for receiving pipe bundles extending axially of the core. The core of each of the elements is stepped and recessed such that a plurality of the elements may be fitted together to form the heat exchanger.

14 Claims, 3 Drawing Figures

TUBE TYPE HEAT EXCHANGER

This is a continuation of application Ser. No. 947,062, filed Sept. 29, 1978, now abandoned.

BACKGROUND AND SUMMARY OF THE INVENTION

The present invention relates to a tube-type heat exchanger and, more particularly, to a tube-type heat exchanger having a core with a spiral baffle around the core.

Tube-type heat exchangers are commercially available wherein a medium flows through the pipes in the pipe bundle and another medium is passed around the pipes by means of baffle plates in such a way that this latter medium always flows transversely into the pipe bundle. The number of baffle plates determines the number of transverse currents. The best known of these heat exchangers consist of sectional or annular partitions. These known heat exchangers have the disadvantage that, as the medium is deflected, longitudinal currents and, in particular, dead spaces are formed which have a detrimental effect on the heat exchange. Moreover, energy is expended in the lengthy deflecting operation, thus resulting in a loss of pressure. As a result of the pressure head which builds up during deflection, so-called by-passes are produced at the pipe passages and between the baffle plates and the casing of the heat exchanger, thus reducing the heating efficiency.

A tube-type heat exchanger of the kind described at the beginning is known from DT-PS No. 809 816. The spiral arrangement of the baffles proposed in this specification is intended to permit a counterflow heat exchange of gas and condensate with simultaneous condensation in the heat exchanger, which is used as a condensation cooler, while ensuring a good separation of the gas flowing upward and the condensate flowing downward, so as to ensure that the gas current interferes as little as possible with the downward flow of condensate. This known heat exchanger consists essentially of four separate parts, a tubular casing, a core, a baffle spiral pushed onto the core, and a pipe bundle passing through holes provided in the baffle spiral. The bores for the individual pipes have to be provided in inclined surfaces and must be axially aligned with one another for each pipe. This construction is therefore relatively complicated and expensive to produce, particularly when made to order, primarily because the spiral has to have more coils. When the apparatus is produced for stockpiling, correspondingly large and expensive storage space is required. In the region of the tubular core, there are relatively large dead spaces in which the heat exchange is minimal. This is true particularly of small diameter heat exchangers with a consequently smaller number of annular cooling pipe arrangements. This results in a reduction in the heating efficiency.

An aim of the present invention therefore is to construct a heat exchanger of the type described above having spiral baffles, in such a way that manufacture can be simplified, particularly in the case of apparatus made to order, and so that the efficiency of the heat exchanger is also improved.

In one aspect of the invention individual, one-piece basic elements are provided, each comprising an integrated core member and spiral baffle member. These basic elements are the same for all sizes and can be assembled to form longer lengths as required, i.e. depending on the requirements and performance of the heat exchanger. By virtue of the fact that the core member and baffle member are integral, the holes required for the cooling or heating medium pipes can be produced in the same casting operation as for the basic elements. Moreover, it is also relatively easy to provide these holes at a later stage due to the shortness of the basic elements and the integral spiral. The fact that casting processes can be used adds considerably to the range of suitable materials. In particular, light casting materials, such as aluminum and aluminum compounds, may advantageously be used, so as to reduce the weight of the apparatus. The production costs can be significantly reduced by using the solution according to the principles of the invention. Storage problems are substantially reduced because only uniform basic elements which can be put together to form larger units have to be stored. Apparatus can be manufactured to order without any additional expense.

Moreover, the use of spiral baffle members has the advantage that the medium to be cooled or heated always flows transversely to the pipes through the heat exchanger, without being deflected. In this way, the above mentioned disadvantages of the commercially available heat exchangers are eliminated and optimum heat exchange is obtained.

Another advantageous feature of the present invention is that the core member is stepped to permit simple, rapid and satisfactory assembly of the basic elements to form larger units. The steps of the core member also preferably are arranged to result in a practically seamless transition from one basic element to another when the elements are assembled to form larger units.

In the case of a spiral with one complete coil, the spiral end surfaces also may be axially aligned with one another and alignment of the basic elements can be made substantially easier or may even be unnecessary, since in the preferred construction of the present invention the spiral ends of adjacent ends of the basic elements abut on one another, which permits fixing in the peripheral direction.

In the present invention dead spaces may be reduced and the heat exchange is improved to an optimum level by axial ribs on the core.

These and other objects, features and advantages of the present invention will be more clearly understood through a consideration of the following detailed description.

BRIEF DESCRIPTION OF THE DRAWINGS

In the course of this description, reference will frequently be made to the attached drawings in which.

DESCRIPTION OF THE PREFERRED EMBODIMENT

Figure 1:
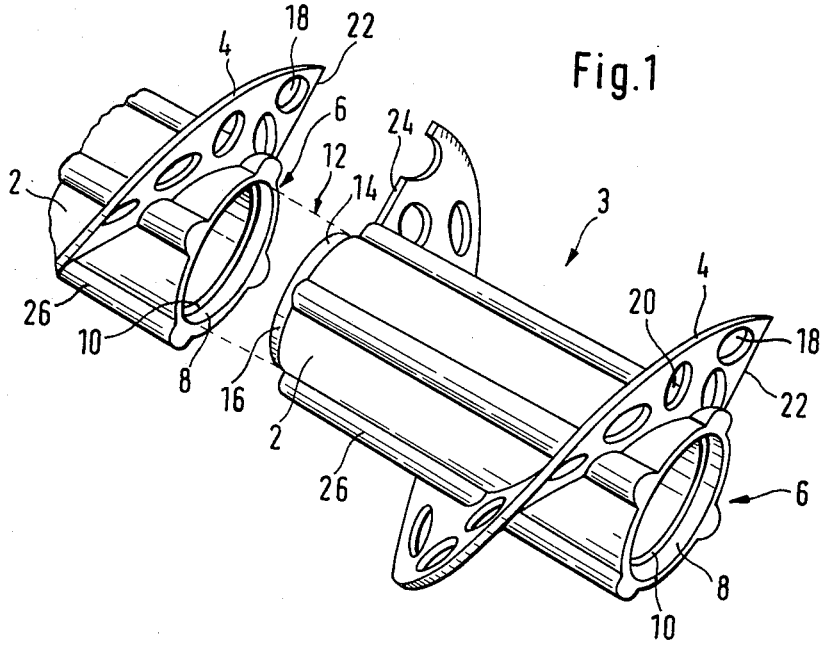
FIG. 1 is a perspective view of a basic element for a heat exchanger constructed according to the invention, and which includes an integrated core member and spiral baffle member, with a second basic element shown in partial view to illustrate the method of assembling two basic elements according to the invention.
Figure 2:
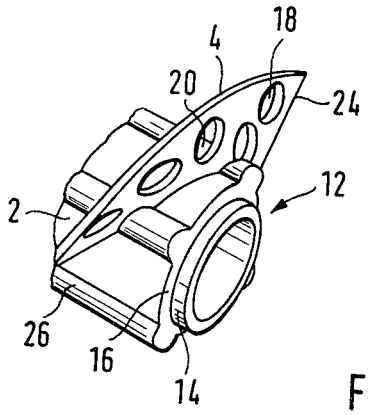
FIG. 2 is a perspective detailed view of the left hand part of the basic element according to the invention, which is hidden in FIG. 1.

Reference will be made first to FIGS. 1 and 2 wherein identical parts have been given the same reference numerals for the sake of simplicity. In these figures a substantially hollow cylindrical core member 2 is shown with a baffle member 4 which is constructed so as to be integral with the core member and is in the form of a spiral with one coil, in this instance. The core member 2 and the baffle member 4 thus form a one-piece basic element 3. Instead of a spiral with one complete coil, the basic element may also comprise spirals with only part of a coil, but in this case the length of the core member always corresponds substantially to the axial length of the spiral or baffle member. The pitch of the spiral may, of course, be adapted to the special requirements of each individual case.

At one end 6, the core member 2 has an internal diameter which widens out in stages so as to form an inner annular recess 8 and in inner step 10. At its other end 12, the core member 2 has an external diameter which decreases in stages, so as to form an outer annular recess 14 and an outer step 16. The reduced external diameter preferably corresponds to the enlarged internal diameter and the depth of the outer step is less than that of the inner step, thus enabling the basic elements to be fitted together.

Viewed in the axial direction, the baffle member 4 is provied with two rows of holes arranged concentrically with each other, holes 18, 20 of which are mounted offset from one another so as to make the pipe bundle (not shown) for the cooling agent as compact as possible. The number of rows of holes and the arrangement of the holes can be varied as required. The spiral of the baffle member is extended at one end 22 beyond the edge of the end 6 of the core member 2 by more or less the thickness of the baffle member and at the other end 24 is approximately in alignment with the step 16, so that, by rotating the basic elements 3 relative to one another, the surfaces of the spiral ends 22 and 24 of adjacent basic elements are made to abut one another and a smooth transition from one spiral to the next is obtained. In addition, this results in a peripheral fixing, so that, owning to the identical construction of the basic elements, the holes 18, 20 are automatically aligned in the axial direction for the insertion of the cooling agent pipes (not shown).

If the holes 18 and 20 are round/or if they are mounted offset, areas are formed between the core member and the holes or the pipes (not shown) which constitute a dead space in which heat exchange is reduced. In order to make this dead space smaller, the core member 2 comprises, on its outer surface, axially extending ribs 26 which are preferably cylindrical (as shown) in order to improve the flow characteristics. The holes may also be some shape other than round.

Suitable materials for the basic element according to the invention include, in particular, all materials which can be used in a casting process. Cast aluminum is particularly suitable owing to its lightness.

Figure 3:
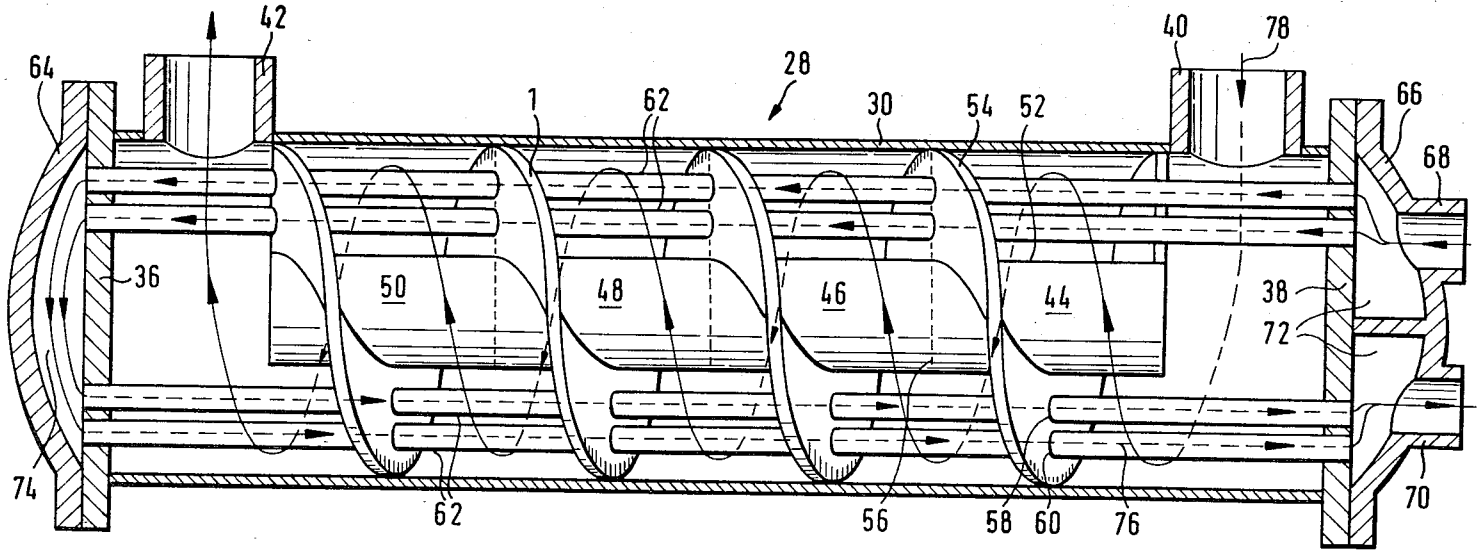
FIG. 3 is a diagrammatic elevation cross sectioned view through a fully assembled heat exchanger using a number of basic elements according to the invention as shown in FIGS. 1 and 2.

Referring now to FIG. 3, which shows a complete tube-type exchanger 28, the heat exchanger comprises a casing 30 which is provied with pipe bases 36 and 38 at both ends.

The casing 30 comprises an inlet connection 40 and an outlet connection 42 for the medium which is to be heated or cooled. Between the connections 40 and 42, four basic elements 44, 46, 48, 50 consisting of an integrated core member and spiral baffle member 52 and 54 are mounted in the casing. The connecting points 56 between the basic elements are shown by dotted lines.

Holes 58, 60 are formed in the baffle members through which a pipe bundle 62 passes surrounding the core member 52, this pipe bundle ending in the pipe bases 36 and 38. The casing 30 is provided with covers 64 and 66 at both ends. Cover 66 is provided with an inlet and an outlet connection 68 and 70, respectively, for the cooling or heating agent. A chamber 72 comprising two compartments are positioned between cover 66 and pipe base 38. A deflection chamber 74 is positioned between cover 64 and pipe base 36. The direction of flow of the cooling or heating agent is shown by the arrows along the broken line 76 and that of the medium which is to be heated or cooled is shown by the arrows along the dash-dot/continuous line 78.

It will be understood that the embodiment of the present invention which has been described is merely illustrative of one of the applications of the principles of the invention. Numerous modifications may be made by those skilled in the art without departing from the true spirit of the invention.

What is claimed is:

1. An element for use in a tube-type heat exchanger comprising:

hollow core means;

spiral baffle means formed integrally with said core means and extending axially thereof, said spiral baffle means being formed on said core means in the form of a spiral which comprises at least part of a coil in said element; and at least one opening in said spiral baffle means for receiving a pipe extending axially of said core means, at least one of said core means and baffle means of said element including aligning means adjacent one end thereof for cooperating with complementary aligning means on another element to align said elements and the pipe receiving openings of the elements with each other, said aligning means comprising the ends of said spiral baffle means in each said element being located in a plane radial to the axis of said core means and one said end projects over the end of said core means.

2. The heat exchanger element of claim 1 wherein said core means comprises a substantially hollow cylinder the internal diameter of which, at one end, is widened in steps by an inner annular recess in the cylinder, and the external diameter of said cylinder, at the other end thereof, is reduced in steps complementary to said first mentioned steps, by an outer annular recess in said cylinder.

3. The heat exchanger element of claim 2 wherein the depth of said outer annular recess is less than the depth of said inner annular recess and the external diameter of said outer annular recess corresponds to the internal diameter of said annular recess.

4. The heat exchanger element of claim 1 wherein said one end of said spiral baffle means projects over the end of said core means by a distance substantially equal to the thickness of said spiral baffle means.

5. The heat exchanger element of claim 1 wherein said hollow core means and said spiral baffle means of said element are integrally cast together.

6. An element for use in a tube-type heat exchanger comprising:

hollow core means comprising a substantially hollow cylinder the internal diameter of which, at one end, is widened in steps by an inner annular recess in the cylinder, and the external diameter of said cylinder, at the other end thereof, is reduced in steps complementary to said first mentioned steps, by an outer annular recess in said cylinder;

spiral baffle means formed integrally with said core means and extending axially thereof; and at least one opening in said spiral baffle means for receiving a pipe extending of said core means;

at least one of said core means and baffle means of said element including aligning means adjacent one end thereof for cooperating with complementary aligning means on another element to align said elements and the pipe receiving openings of the elements with each other, said aligning means comprising the ends of said spiral baffle means in said element being located in a plane radial to the axis of said core means and one said end projects over the end of said core means.

7. The heat exchanger element of claim 6 wherein said one end of said spiral baffle means projects over the end of said core means by a distance substantially equal to the thickness of said spiral baffle means.

8. The heat exchanger element of claim 6 wherein the depth of said outer annular recess is less than the depth of said inner annular recess and the external diameter of said outer annular recess corresponds to the internal diameter of said annular recess.

9. The heat exchanger element of claim 6 wherein said hollow core means and said spiral baffle means of said element are integrally cast together.

10. An element for use in a tube-type heat exchanger comprising:

hollow core means;

at least one axially extending molded rib on the outer surface of the core means of said element, said rib passing through said spiral baffle means in portions thereof spaced from said pipe bundle;

spiral baffle means formed integrally with said core means and extending axially thereof; and at least one opening in said spiral baffle means for receiving a pipe extending axially of said core means;

at least one of said core means and baffle means of said element including aligning means adjacent one end thereof for cooperating with complementary aligning means on another element to align said elements and the pipe receiving openings of the elements with each other.

11. The heat exchanger element of claim 10 wherein said rib is cylindrical.

12. The heat exchanger element of claim 10 wherein said core means comprises a substantially hollow cylinder the internal diameter of which, at one end, is widened in steps by an inner annular recess in the cylinder, and the external diameter of said cylinder, at the other end thereof, is reduced in steps complementary to said first mentioned steps, by an outer annular recess in said cylinder.

13. The heat exchanger element of claim 12 wherein the depth of said outer annular recess is less than the depth of said inner annular recess and the external diameter of said outer annular recess corresponds to the internal diameter of said annular recess.

14. The heat exchanger element of claim 10 wherein said hollow core means and said spiral baffle means of said element are integrally cast together.

* * * * *

UNITED STATES PATENT AND TRADEMARK OFFICE

CERTIFICATE OF CORRECTION

PATENT NO. : 4,360,059

DATED : November 23, 1982

INVENTOR(S) : Karl-Heinz Funke

It is certified that error appears in the above-identified patent and that said Letters Patent are hereby corrected as shown below:

Col. 3, line 21 - delete "in" and insert --an--.

Col. 3, line 30 - delete "provied" and insert --provided--.

Col. 3, line 49 - delete "round/or" and insert --round and/or--.

Col. 3, line 64 - delete "provied" and insert --provided--.

Signed and Sealed this

*Fifteenth* Day of *February 1983*

[SEAL]

*Attest:*

GERALD J. MOSSINGHOFF

*Attesting Officer*

*Commissioner of Patents and Trademarks*